US006309594B1

(12) United States Patent
Meeks, III et al.

(10) Patent No.: US 6,309,594 B1
(45) Date of Patent: Oct. 30, 2001

(54) METAL CONSOLIDATION PROCESS EMPLOYING MICROWAVE HEATED PRESSURE TRANSMITTING PARTICULATE

(75) Inventors: Henry S. Meeks, III, Roseville; Lucile Lansing, Carmichael, both of CA (US)

(73) Assignee: Ceracon, Inc., Carmichael, CA (US)

( * ) Notice: Subject to any disclaimer, the term of this patent is extended or adjusted under 35 U.S.C. 154(b) by 0 days.

(21) Appl. No.: 09/339,691

(22) Filed: Jun. 24, 1999

(51) Int. Cl.[7] ..... H05B 6/78; H05B 6/80

(52) U.S. Cl. ..... 419/52; 419/38; 264/432; 264/489; 264/490; 264/604; 75/10.13; 204/157.43; 219/678; 219/756

(58) Field of Search ..... 419/49, 38, 52; 264/432, 474, 489, 490, 604; 75/10.13; 204/157.43; 219/756, 678

(56) References Cited

U.S. PATENT DOCUMENTS

| | | | | |
|---|---|---|---|---|
| 4,499,048 | * | 2/1985 | Hanbejko | 419/49 |
| 4,499,049 | | 2/1985 | Hanejko | 419/49 |
| 4,501,718 | * | 2/1985 | Bradt | 419/49 |
| 4,539,175 | * | 9/1985 | Lichti et al. | 419/49 |
| 4,640,711 | * | 2/1987 | Lichti et al. | 75/248 |
| 4,915,605 | * | 4/1990 | Chan et al. | 419/6 |
| 4,938,673 | * | 7/1990 | Adrian | 419/23 |
| 5,032,352 | * | 7/1991 | Meeks et al. | 419/8 |
| 5,110,542 | * | 5/1992 | Conaway | 419/25 |
| 5,549,731 | * | 8/1996 | Cline et al. | 75/244 |
| 5,736,092 | * | 4/1998 | Apte et al. | 264/432 |
| 6,123,896 | * | 9/2000 | Meeks, III et al. | 419/49 |

* cited by examiner

*Primary Examiner*—Daniel J. Jenkins
(74) *Attorney, Agent, or Firm*—William W. Haefliger

(57) ABSTRACT

A method of consolidating metal powder to form an object, includes:

a) pressing the powder into a preform, and preheating the preform to elevated temperature, b) providing flowable pressure transmitting particles and transmitting microwaves into the particles to heat same, and providing a bed of the flowable and heated pressure transmitting particles, c) positioning the preform in such relation to the bed that the particles substantially encompass the preform, d) and pressurizing the bed to compress said particles and cause pressure transmission to the preform, thereby to consolidate the preform into a desired object shape.

39 Claims, 4 Drawing Sheets

METAL CONSOLIDATION PROCESS EMPLOYING MICROWAVE HEATED PRESSURE TRANSMITTING PARTICULATE

BACKGROUND OF THE INVENTION

This invention relates generally to the field of consolidating metallic bodies, and more particularly to rapid and efficient and heating and handling of granular media employed in such consolidation, as well as rapid and efficient heating and handling of pre-form powdered metal or metal and ceramic particulate material bodies to be consolidated.

The technique of employing carbonaceous particulate or grain at high temperature as pressure transmitting media for producing high density metallic objects is discussed at length in U.S. Pat. Nos. 4,140,711, 4,933,140 and 4,539,175, the disclosures of which are incorporated herein, by reference.

The present invention provides improvements in such techniques, and particularly improvements in heating of the granular media to be used to transmit pressure to the body and/or forged preform to be consolidated.

SUMMARY OF THE INVENTION

It is a major object of the invention to provide rapid and efficient microwave heating of carbonaceous and/or ceramic particles used as pressure transmitting media, and also transfer of heat generated in the particles to the work, i.e. the pre-form to be consolidated. Basic steps of the method of consolidating a metallic, metallic and ceramic, or ceramic body in any of initially powdered, sintered, fibrous, sponge, or other form capable of compaction, or densification (to reduce porosity) then include the steps:

a) providing flowable particles having carbonaceous and ceramic composition or compositions, b) providing microwaves acting to heat said particles to elevated temperature, c) locating said heated particles in a bed, d) positioning said body at said bed, to receive pressure transmission, e) effecting pressurization of said bed to cause pressure transmission via said particles to said body, thereby to compact the body into desired shape, increasing its density; and f) the body to be consolidated consisting of one of the following:

i) metallic material ii) ceramic material iii) a mixture of metallic and ceramic material iv) polymeric material, or polymeric composite material.

Typically, the pressure transmitting material (PTM), or particulate, is placed in a container to receive microwave energy from an external source, and for a time period, and at transmitted frequencies to achieve rapid and controllable heating of the PTM, to be subsequently transferred to a container wherein body consolidation is effected. Simultaneous, or near simultaneous heating of all particles is thereby achieved, for uniformity. Also, need for electrical resistance only heating by use of exclusively resistance elements in the PTM is thereby obviated. Microwave heating combined with some electrical resistance heating is contemplated.

A further object is to provide for flow of the PTM particles during such microwave heating, as by fluidization of a bed of such particles in the path of microwave transmission.

By the use of the methodology of the present invention, substantially improved structural articles of manufacture can be made having minimal distortion, as particularly enabled by the use of carbonaceous, or ceramic, or carbonaceous/ceramic particulate in flowable form.

An additional object include provision of a method for consolidating metal and/or ceramic powder, and/or composite material with or without polymeric powder, to form an object, that includes a) pressing said powder into a preform, and preheating the preform to elevated temperature, b) providing flowable pressure transmitting particles and transmitting microwaves into said particles to heat same, and providing a bed of said flowable and heated pressure transmitting particles, c) positioning the preform in such relation to the bed that the particles substantially encompass the preform, b) and pressurizing said bed to compress said articles and cause pressure transmission via the particles to the preform, thereby to consolidate the preform into a desired object shape, having final density.

The novel features which are believed to be characteristic of this invention, both as to its organization and method of operation, together with further objectives and advantages thereof, will be better understood from the following description considered in connection with the accompanying drawings in which a presently preferred embodiment of the invention is illustrated by way of example. It is to be expressly understood, however, that the drawings are for the purposes of illustration and description only and are not intended as a definition of the limits of the invention.

DRAWING DESCRIPTION

DETAILED DESCRIPTION

Figure 1:
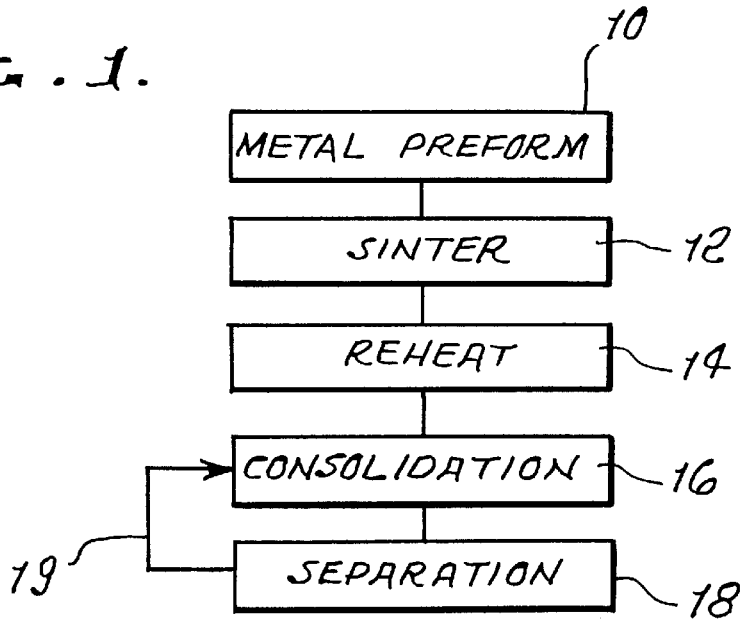
FIG. 1 is a flow diagram showing the method steps of the present invention.

Referring first to FIG. 1, there is shown a flow diagram illustrating the method steps of the present invention. As can be seen from numeral 10, initially a metal, metal and ceramic, or ceramic article of manufacture or pre-form is made, for example, in the shape of a wrench or other body or tool. While the preferred embodiment contemplates the use of a metal pre-form made of powdered steel particles, other metals and ceramic materials, polymer, intermetallics, and refractives, such as silicon nitride, alumina, and the like, are also within the scope of the invention. A pre-form typically is about 85 percent of theoretically density after the powder has been made into a pre-formed shape, and it is typically subsequently sintered in order to increase the strength. In the preferred embodiment, the heating of the metal (steel) pre-form requires temperatures in the range of about 200° C. to 1,800° C. for a time of about 2–30 minutes in a protective atmosphere, sintering temperature for alumina being about 300° C. In the preferred embodiment, such protective, non-oxidizing inert atmosphere is nitrogen-based or Argon based. Subsequent to sintering, illustrated at 12, the pre-forms can be stored for later processing. Should such be the case, as illustrated at 14, the pre-form is subsequently reheated to approximately 1950° F., as in a protective atmosphere, or as disclosed herein.

The consolidation process, illustrated at 16, takes place after the hot pre-form has been placed in a bed of heated carbonaceous or carbonaceous/ceramic particles as hereinbelow discussed in greater detail. Further, in order to speed up production, consolidation can take place subsequent to sintering, so long as the pre-form is not permitted to cool. Consolidation takes place by subjecting the embedded pre-form to high temperature and pressure. For metal (steel) objects, temperatures in the range of about 2,000° F. and uniaxial pressures of about 5 to 100 and higher TSI are used, for compaction. The pre-form has now been densified and can be separated, as noted at 18, whereby the carbonaceous particles separate readily from the pre-form and can be recycled as indicated at 19. If necessary, any particles adhering to the pre-form can be removed and the final product can be further finished.

Figure 2:
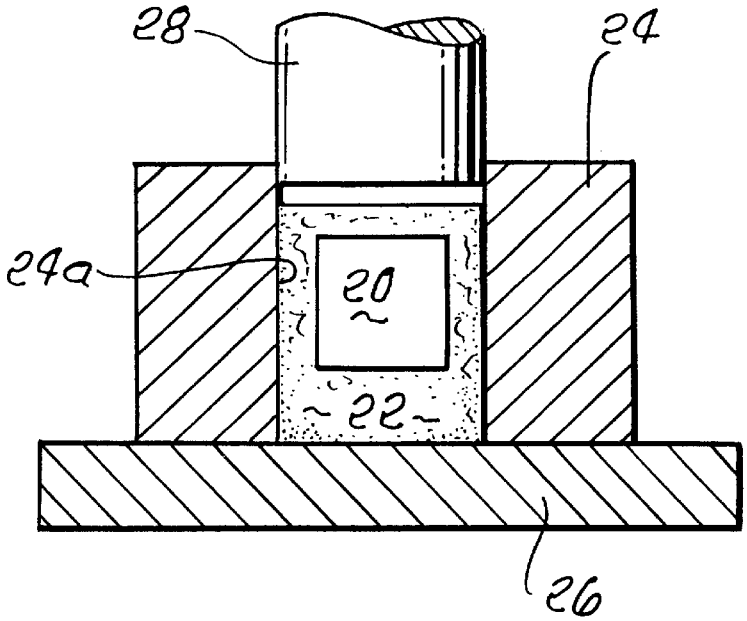
FIG. 2 is a cut-away elevation showing the consolidation step of the present invention.

Final product dimensional stability, to a high and desirable degree, is obtained when the particle (grain) bed primarily (and preferably substantially completely) consists of flowable carbonaceous and/or ceramic particles. For best results, such carbonaceous particles are resiliently compressible graphite beads, and they have outward projecting nodules on and spaced part on their generally spheroidally shaped outer surfaces, as well as surface fissures. See for example U.S. Pat. No. 4,640,711. Their preferred size is between 50 and 240 mesh. Useful granules are further identified as desulphurized petroleum coke. Such carbon or graphite particles have the following additional advantages in the process:

1. They form easily around corners and edges, to distribute applied pressure essentially uniformly to and over the body being compacted. The particles suffer very minimal fracture, under compaction pressure.
2. The particles are not abrasive, therefore reduced scoring and wear of the die is achieved.
3. They are elastically deformable, i.e. resiliently compressible under pressure and at elevated temperature, the particles being stable and usable up to 4,000° F.; it is found that the granules, accordingly, tend to separate easily from (i.e. do not adhere to) the body surface when the body is removed from the bed following compaction.
4. The granules do not agglomerate, i.e. cling to one another, as a result of the body compaction process. Accordingly, the particles are readily recycled, for reuse, as at 19 in FIG. 1.
5. The graphite particles become rapidly heated in response to passage of microwaves therethrough. The particles are stable and usable at elevated temperatures up to 4,000° F. Even though graphite oxidizes in air at temperatures over 800° F. Short exposures as during heatup and cooldown, do not substantially harm the graphite particles. Referring now to FIG. 2, the consolidation step is more completely illustrated. In the preferred embodiment, the pre-form 20 has been completed embedded in a bed of carbonaceous particles 22 as described, and which in turn have been placed in a contained zone 24*a* as in consolidation die 24. Press bed 26 forms a bottom platen, while hydraulic press ram 28 defines a top and is used to press down onto the particles 22 which distributes the applied pressure substantially uniformly to pre-form 20. The pre-form is at a temperature between 200° C. and 1,800° C., prior to compaction. The embedded metal powder pre-form 20 is rapidly compressed under high uniaxial pressure by the action of ram 28 in die 24, the grain having been heated to between 400° C. and 4,000° F. Pressurization is typically effected at levels greater than about 20,000 psi for a time interval of less than about 30 seconds. Particles may be located within a sub-bed in a deformable container, in bed 22.

Figure 3:
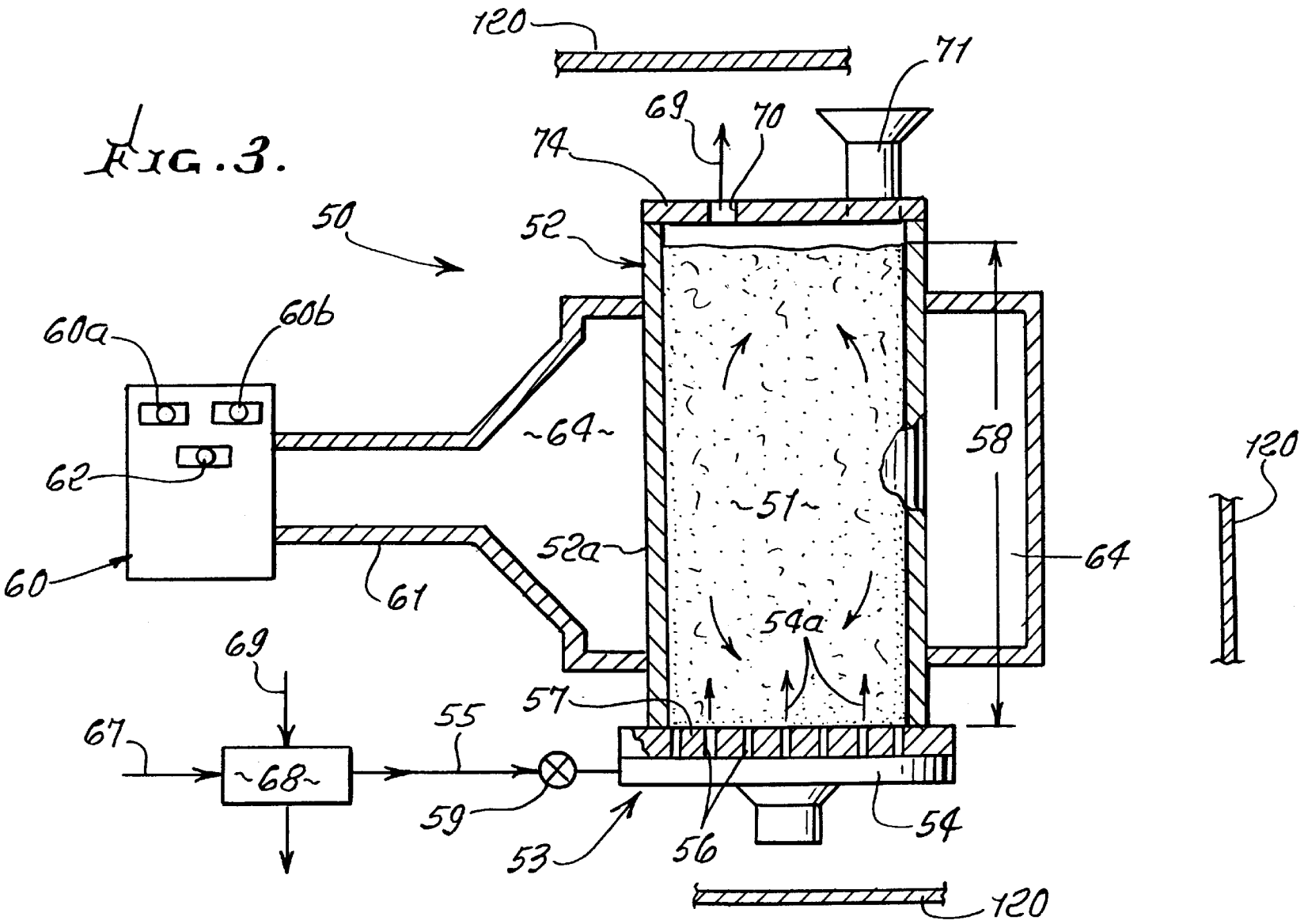
FIG. 3 is a vertical section showing a microwave grain heater assembly.

Referring now to FIG. 3, a heating furnace 50 is shown, incorporating a fluidized bed of grain particles, indicated at 51. Such PTM can be a carbonaceous and ceramic composite of varying composition ranging from 5 to 95 percent, by volume, of ceramic particles, the balance being carbonaceous particles. Usable ceramics include: aluminum oxide, boron carbide or nitride, and other hard ceramic materials.

The heater includes a thin wall tube 52 of microwave transmitting material (alumina for example) having the form of a right cylinder but can be triangular, square or almost any shape, from the top view. Attached and sealed to the bottom of the tube is a base 53 which is constructed as a hollow chamber, a plenum 54 located within the hollow base, and into which a non-oxidizing gas (normally nitrogen) is introduced at 55. The gas exits the plenum upwardly through a pattern of small holes 56 drilled through a diffuser plate 57. The diffuser is flat and is mounted horizontal and level. The tube's walls are perpendicular to the top of the diffuser.

The "media" 51 is poured into the tube, filling the tube from the diffuser to a sufficient depth indicated at 58. This column of media is fluidized by the gas existing the plenum 54 at 54*a*. Fluidization causes the column of media to expand and reduces its density. By controlling the gas flow at 59, the density of the column can be controlled at specific levels. The reduction of density favors microwave heating. Fluidization also causes the column to churn and mix. This mixing rate can also be changed by changing the gas flow. Particle mesh size is between 50 and 240.

The heating rate of the entire column is also dependent on the mixing rate (which is controlled by the gas flow rate). A source of microwave energy is shown at 60, with controls 60*a* and 60*b* (time and power). Such energy is conveyed, via waveguide 61, to the side 52*a* of tube 52, and is transmitted through that side wall to the tube interior for microwave energy absorption by the PTM to heat same. Usable frequencies are 0.915 $GH_z$. and/or 2.45 $GH_z$. Other frequencies are usable, such as up to 24.0 $GH_z$, Tube 52 extends vertically within surrounding microwave chamber 64. The heating rate is controlled by the source power output, ranging from 1.0 KW to 10.0 KW, and higher. See control 62.

The temperature of the incoming gas such as $N_2$ can have a marked effect on the heating rate. If the inert, fluidizing gas is supplied from a vaporizing liquid source, as at 67, such as commercially available liquid nitrogen, its low temperature will cool the grain column. This cooling effect can be reduced by passing the gas through a heat exchanger 68 warmed by the exhaust 69 exiting the media heater at vent 70 in the cover plate 74. A PTM loading inlet appears at 71. Air is preferably excluded from the bed.

Heating temperature of the PTM ranges from a few hundred degrees C (200 to 700) as for use in aluminum powder consolidation into a consolidated body, such as a forging, to 1500 degrees C and above for use in consolidation of powdered ceramic materials. An upper limit for heating temperature of the PTM is about 1800C.

Heating times for the PTM in the tube 52 vary from about 5 minutes for smaller quantities, 1 kg for example, to about 60 minutes for large quantities, 250 kg for example. Use of microwave heating of the fluidized bed 51 rapidly achieves uniform elevated temperatures of the PTM in the tube. A shielding enclosure 120 assures containment of microwave radiation.

Figure 4:
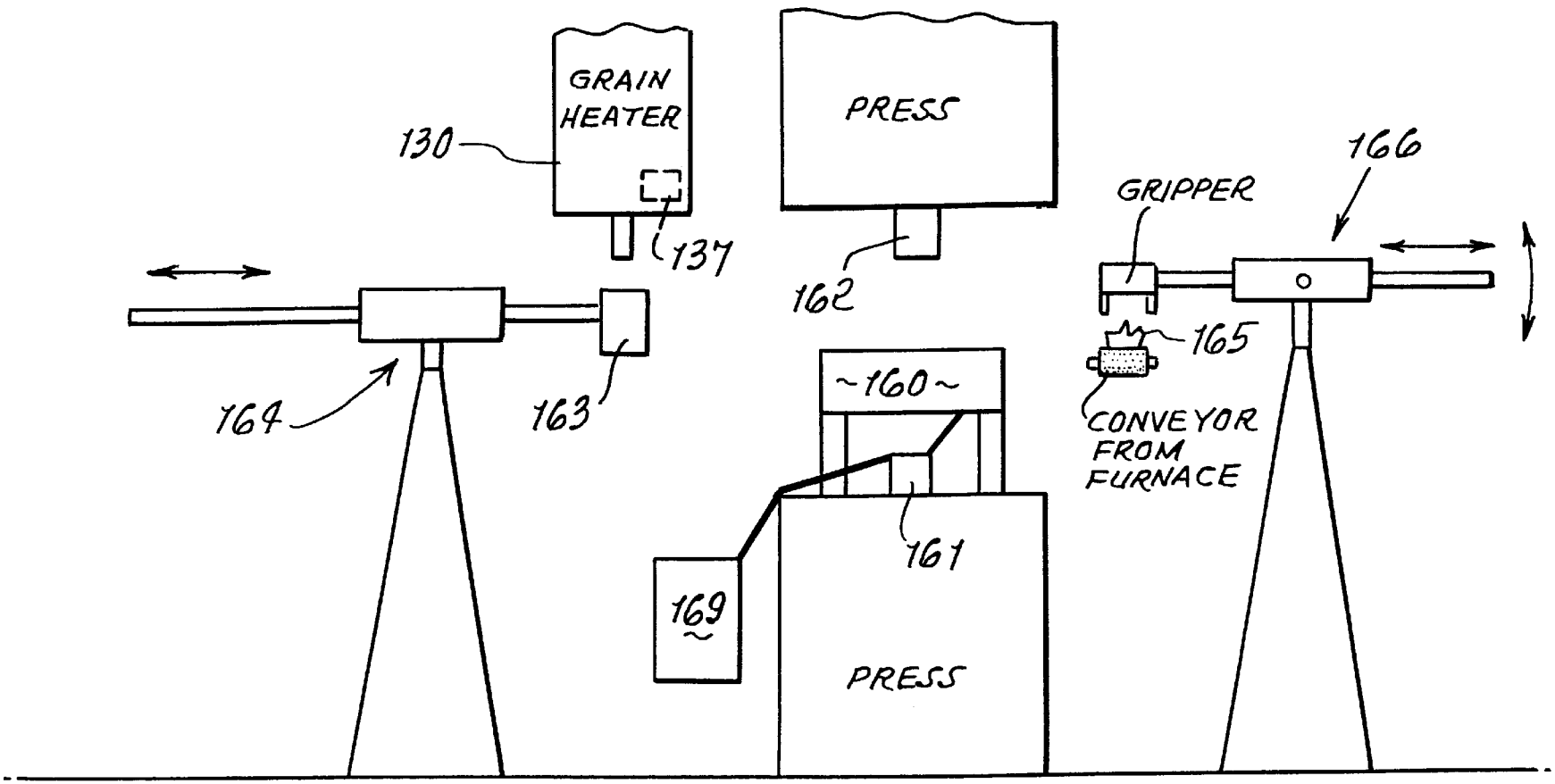
FIG. 4 shows transfer equipment.

FIG. 4 shows transfer equipment associated with the die 160, lower punch 161 and upper punch 162. Grain, heated at 130 in the manner described in FIG. 3, flows downwardly to transfer cup 163 which is then shifted by robot 164 toward and above die 160. The cup is inverted, and grain is poured into the die. A pre-heated part or pre-form 165, obtained from the tunnel 136 is maneuvered by robot 166 and placed into the grain within the die. The upper punch 162 is then lowered to compress the grain which transfers pressure to the pre-form to consolidate the part. See FIG. 2. After such consolidation, the lower punch 161 is lowered and the part retrieved. The PTM grain easily flows off the part and is collected in bin 169 for re-use.

Figure 5:
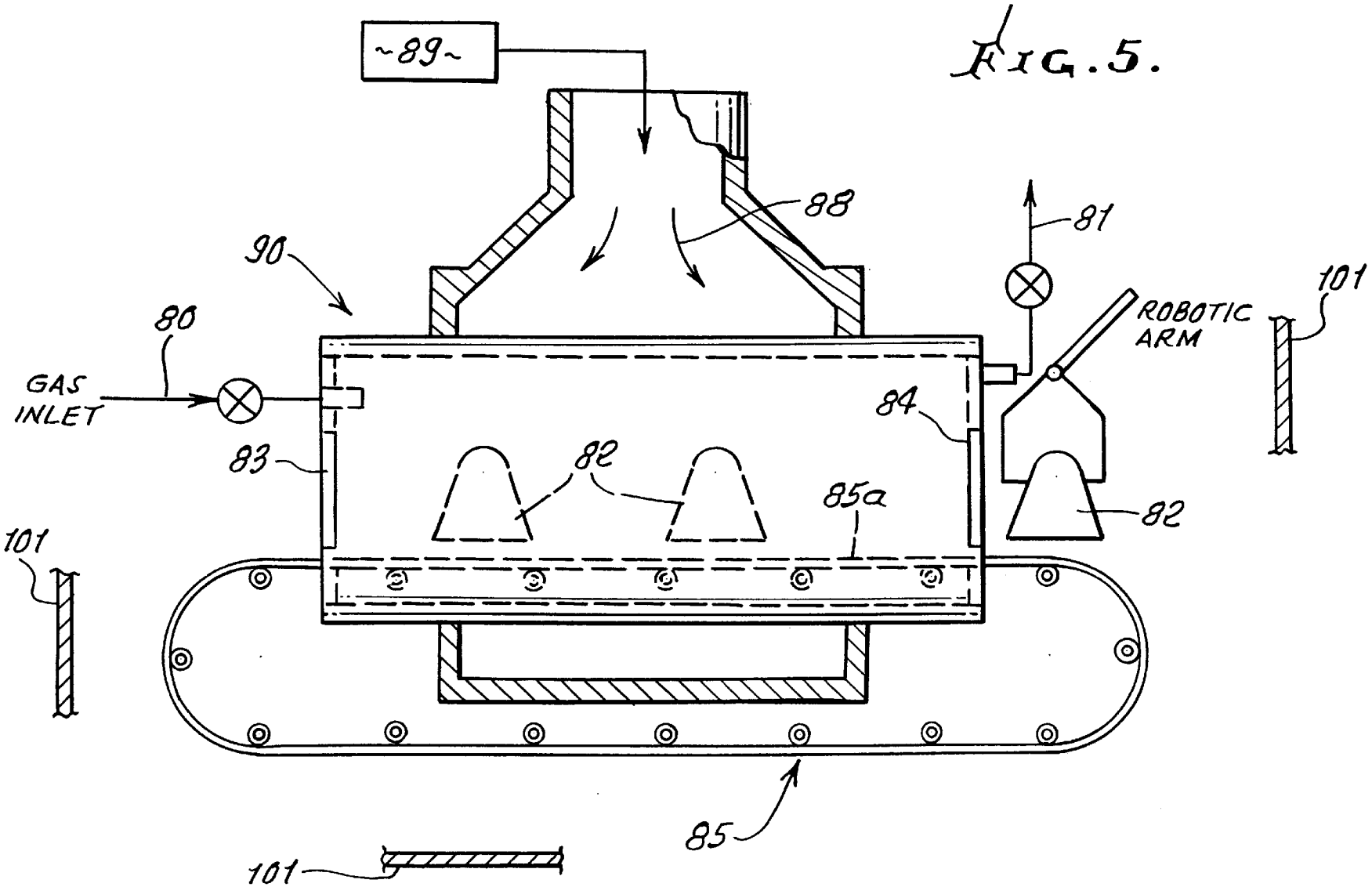
FIG. 5 shows a modification.

Referring to FIG. 5, it shows that location of a hollow tube 90 in a horizontal position. Inert gas inlet 80 and outlet 81 at opposite end walls of the tube enable continuous flow of inert gas through the tube. The gas may consist of nitrogen, Argon or other sintering gas.

Pre-form 82 to be heated are slowly traveled through the tube, as via gates 83 and 84 in the tube end walls. An endless conveyor 85 has an upper stretch 85*a* that supports the preforms.

Microwaves 88 supplied by a generator 89 pass into and through the wall of the tube, flooding the tube interior, and heating the preforms. A shielding enclosure 101 assures containment of microwave radiation.

Forging preforms are typically made of metallic, ceramic, intermetallic, metal and ceramic composites and other particulate materials, as well as other conventionally produced fully dense bodies.

We claim:

1. In the method of consolidating a body in any of initially powdered, sintered, fibrous, or sponge form, that includes the steps:

a) providing flowable particles having carbonaceous and ceramic composition or compositions, b) providing microwaves acting to heat said particles to elevated temperature, c) locating said heated particles in a bed, d) fluidizing said heated particles during at least one of said b) and c) steps, e) positioning said body at said bed, to receive pressure transmission, f) effecting pressurization of said bed to cause pressure transmission via said particles to said body, thereby to compact the body into desired shape, increasing its density, and g) the body to be consolidated consisting of one of the following:
i) metallic material,
ii) ceramic material,
iii) a mixture of metallic and ceramic material,
iv) intermetallic and composite material,
v) polymeric and composite material,
vi) partially densified material.

2. The method of claim 1 including confining said particles in a container during said heating thereof, and providing a source of said microwaves transmitted into the particles in the container.

3. In the method of consolidating a body in any of initially powdered, sintered, fibrous, or sponge form, that includes the steps:

a) providing flowable particles having carbonaceous and ceramic composition or compositions, b) providing microwaves acting to heat said particles to elevated temperature, c) locating said heated particles in a bed, d) positioning s aid body at said bed, to receive pressure transmission, e) effecting pressurization of said bed to cause pressure transmission via said particles to said body, thereby to compact the body into desired shape, increasing its density; and f) the body to be consolidated consisting of one of the following:
i) metallic material,
ii) ceramic material,
iii) a mixture of metallic and ceramic material,
iv) intermetallic and composite material,
v) polymeric and composite material,
vi) partially densified material, g) and said step b) including fluidizing said particles during said heating thereof.

4. The method of claim 3 wherein said fluidizing is carried out by passing gas into the bed, during transmission of microwaves into the bed.

5. The method of claim 2 wherein said source is a microwave power source having an output range between 0.915 GHZ to 24 GH.

6. The method of claim 5 including continuing said microwave transmission for 5 to 60 minutes.

7. The method of claim 1 wherein said elevated temperature is between 200° C. and 1,800° C.

8. The method of claim 2 including excluding entrance of air to the bed.

9. In the method of consolidating a body in any of initially powdered, sintered, fibrous, or sponge form, that includes the steps:

a) providing flowable particles having carbonaceous and ceramic composition or compositions, b) providing microwaves acting to heat said particles to elevated temperature, c) locating s aid heated particles in a bed, d) positioning said body at said bed, to receive pressure transmission, e) effecting pressurization of said bed to cause pressure transmission via said particles to said body, thereby to compact the body into desired shape, increasing its density; and f) the body to be consolidated consisting of one of the following:
i) metallic material,
ii) ceramic material,
iii) a mixture of metallic and ceramic material,
iv) intermetallic and intermetallic composite material,
v) polymeric and polymeric composite material, g) and said step b) including confining said particles in a column during said heating thereof.

10. In the method of consolidating a body in any of initially powdered, sintered, fibrous, or sponge form, that includes the steps:

a) providing flowable particles having carbonaceous and ceramic composition or compositions, b) providing microwaves acting to heat said particles to elevated temperature, c) locating said heated particles in a bed, d) positioning said body at said bed, to receive pressure transmission, e) effecting pressurization of said bed to cause pressure transmission via said particles to said body, thereby to compact the body into desired shape, increasing its density; and f) the body to be consisting of one of the following:
i) metallic material,
ii) ceramic material,
iii) a mixture of metallic and ceramic material,
iv) intermetallic and intermetallic composite material,
v) polymeric and polymeric composite material, g) and said step b) including confining said particles in a column during said heating thereof, the microwaves directed sidewardly into said column, and effecting fluidization of the particles during said heating.

11. The method of claim 1 wherein said particles are generally spheroidal and consist of graphite, and/or graphite and ceramic composite.

12. The method of claim 1 wherein said body in said bed, prior to said compaction, is at a temperature between about 200° C. and 1,800° C.

13. The method of claim 1 wherein said body is positioned in said bed to be surrounded by said particulate, the bed consisting substantially entirely of particles in the form of graphite and/or graphite/ceramic beads.

14. The method of claim 1 wherein said pressurization is carried out to compress the particulate closest to the body, so that when the compacted body is removed from said bed, the particulate closest to the body flows off the body.

15. The method of claim 1 wherein said bed contains sufficient of said flowable particles as to remain essentially free of agglomeration during said (e) step.

16. The method of claim 1 wherein said bed consists essentially of one of the following particulates:
i) graphite
ii) ceramic
iii) graphite and ceramic.

17. The method of claim 1 wherein the particle mesh size is between 50 and 240.

18. In the method of consolidating a body in any of initially powdered, sintered, fibrous, sponge, or other form capable of compaction, that includes the steps:

a) providing flowable particles having carbonaceous and ceramic composition or compositions, b) providing microwaves acting to heat said particles to elevated temperature, c) locating said heated particles in a bed, d) positioning said body at said bed, to receive pressure transmission, e) effecting pressurization of said bed to cause pressure transmission via said particles to said body, thereby to compact the body into desired shape, increasing its density; and f) the body to be consolidated consisting of one of the following:
ii metallic material,
ii) ceramic material,
iii) a mixture of metallic and ceramic material,
iv) intermetallic and composite material,
v) polymeric and composite material,
vi) partially densified material, g) and wherein said particles consist of from 5 to 95 percent, by volume, of ceramic material.

19. The consolidated body produced by the method of claim 1.

20. The method of consolidating metal powder to form an object, that includes:

a) pressing said powder into a preform, and preheating the preform to elevated temperature, b) providing flowable pressure transmitting particles and transmitting microwaves into said particles to heat same while confining said particles in a column during said heating thereof, and providing a bed of said flowable and heated pressure transmitting particles, c) positioning the preform in such relation to the bed that the particles substantially encompass the preform, d) and pressurizing said bed to compress said particles and cause pressure transmission via the particles to the preform, thereby to consolidate the preform into a desired object shape.

21. The method of claim 20 wherein said pressurization is effected at levels greater than about 20,000 psi for a time interval of less than about 30 seconds.

22. The method of consolidating metal powder to form an object, that includes:

a) pressing said powder into a preform, and preheating the preform to elevated temperature, b) providing flowable pressure transmitting particles and transmitting microwaves into said particles to heat same, and providing a bed of said flowable and heated pressure transmitting particles, c) positioning the preform in such relation to the bed that the particles substantially encompass the preform, d) and pressurizing said bed to compress said particles to the preform, thereby to consolidate the preform into a desired object shape, e) said step c) including providing an evacuated and sealed, deformable metallic container in the bed, and locating the preform in the container with bed particles inside the container and outside the container, prior to said pressurization.

23. The method of claim 22 wherein bed particles outside the container are pressurized to deform the container and transmit pressurization to bed particles in the container.

24. The method of claim 23 wherein said pressurization is effected for a time interval of less than about 30 seconds, and at pressure levels in excess of about 20,000 psi.

25. The method of claim 20 including heating the preform to temperature in excess of 200° C. prior to said step d).

26. The method of claim 21 including heating the preform to temperature in excess of 200° C. prior to said step d).

27. The method of claim 22 including heating the preform to temperature in excess of 200° C. prior to said step d).

28. The method of claim 20 wherein the pressure transmitting particles are one of the following:
i) carbonaceous
ii) ceramic
iii) mixtures of i) and ii), with other materials.

29. The method of claim 28 wherein the pressure transmitting particles in the bed are preheated to elevated temperatures between 400° F. and 4,000° F.

30. The method of claim 20 wherein the preform is pre-heated to elevated temperature between 200° C. and 1,800° C.

31. The method of claim 20 wherein the preheated preform is positioned in said bed, the particles of which are at elevated temperatures.

32. The consolidated object produced by the method of claim 26.

33. The consolidated object produced by the method of claim 27.

34. The method of claim 20 wherein said preheating of the preform includes passing microwaves into the preform.

35. The method of consolidating metal powder to form a n object, that includes:

a) pressing said powder into a preform, and preheating the preform to elevated temperature, b) providing flowable pressure transmitting particles and transmitting microwaves into said particles to heat same, and providing a bed of said flowable and heated pressure transmitting particles, c) positioning the preform in such relation to the bed that the particles substantially encompass the preform, d) and pressurizing said bed to compress said particles and cause pressure transmission via the particles to the preform, thereby to consolidate the preform into a desired object shape, e) said preheating of the preform including passing microwaves into the preform, f) and wherein said step a) includes providing a treatment chamber into which preforms are positioned, and providing a microwaves generator and transmitting microwaves from the generator into said chamber.

36. The method of claim 35 including transporting preforms through said chamber.

37. The method of claim 35 including flowing inert gas through said chamber during transmission of microwaves to the preforms.

38. The method of claim 36 including providing and operating a conveyor to transport the preforms through the chamber.

39. The method that includes a) providing particles to be used in pressure consolidation of a powdered preform, b) heating said particles by transmitting microwaves into the particles, c) locating the powdered preform to receive pressure transmission from the heated particles and pressurizing the heated particles to effect said consolidation of the powdered preform, d) and fluidizing said particles during said heating thereof.

* * * * *